United States Patent [19]

Trinh et al.

[11] Patent Number: 4,855,072

[45] **Date of Patent: * Aug. 8, 1989**

[54] LIQUID FABRIC SOFTENER

[75] Inventors: Toan Trinh, Maineville; Errol H. Wahl, Cincinnati; Donald M. Swartley, Cincinnati; Ronald L. Hemingway, Cincinnati, all of Ohio

[73] Assignee: The Procter & Gamble Company, Cincinnati, Ohio

[ * ] Notice: The portion of the term of this patent subsequent to Apr. 28, 2004 has been disclaimed.

[21] Appl. No.: 28,048

[22] Filed: Jul. 2, 1987

Related U.S. Application Data

[63] Continuation of Ser. No. 717,051, Mar. 28, 1985, Pat. No. 4,661,269.

[51] Int. Cl.[4] ..... D06M 11/00

[52] U.S. Cl. ..... 252/8.8; 252/8.75

[58] Field of Search ..... 252/8.75, 8.8

[56] References Cited

U.S. PATENT DOCUMENTS

| | | | |
|---|---|---|---|
| 3,644,203 | 2/1972 | Lamberti et al. | 252/8.8 |
| 3,775,316 | 11/1973 | Berg et al. | 252/8.8 |
| 3,904,533 | 9/1975 | Neiditch et al. | 252/8.8 |
| 3,974,076 | 8/1976 | Wiersema | 252/8.8 |
| 4,327,133 | 4/1982 | Rudy et al. | 252/8.8 |
| 4,399,045 | 8/1983 | Burns | 252/8.75 |
| 4,421,792 | 12/1983 | Rudy et al. | 252/8.8 |
| 4,424,134 | 1/1984 | Sussin et al. | 252/8.8 |
| 4,426,299 | 1/1984 | Verbruggen | 252/8.8 |
| 4,439,335 | 3/1984 | Burns | 252/8.75 |
| 4,460,485 | 7/1984 | Rapisarda et al. | 252/8.75 |
| 4,464,272 | 8/1984 | Parslow et al. | 252/8.8 |
| 4,526,694 | 7/1985 | Puchta et al. | 252/8.8 |

OTHER PUBLICATIONS

"Condensation Products from β-Hydroxyethylenediamine and Fatty Acids or Their Alkyl Esters and Their Application as Textile Softeners in Washing Agents", H. W. Eckert, *Fette-Seifen-Anstrichmittel,* Sep. 1972, pp. 527–533.

"Cationic Surface Active Agents as Fabric Softeners," R. R. Egan, *Journal of the American Oil Chemists Society,* Jan. 1978, pp. 118–121.

"How to Choose Cationics for Fabric Softeners", J. A. Ackerman, *Journal of the American Oil Chemists Society,* Jun. 1983, pp. 1166–1169.

"Cationic Fabric Softeners", W. P. Evans, *Industry and Chemistry,* Jan. 1969, pp. 893–903.

*Primary Examiner*—Paul Lieberman

*Assistant Examiner*—Willie J. Thompson

*Attorney, Agent, or Firm*—Leonard Williamson; Richard C. Witte

[57] ABSTRACT

Liquid fabric softening compositions for use in a rinse bath after washing fabrics with a detergent. The softening compositions contain (a) the reaction products of higher fatty acids with a polyamine selected from the group consisting of hydroxyalkylalkylenediamines and dialkylenetriamines and mixtures thereof, (b) cationic nitrogenous salts having only one long chain acyclic aliphatic hydrocarbon group, and optionally (c) cationic nitrogenous salts having two or more long chain acyclic aliphatic hydrocarbon groups or one said group and an arylalkyl group; these compositions provide good softening performance across major types of detergents.

23 Claims, No Drawings

LIQUID FABRIC SOFTENER

This is a continuation of application Ser. No. 717,051 filed on Mar. 28, 1985, now U.S. Pat. No. 4,661,269.

TECHNICAL FIELD

This invention relates to compositions and methods for softening fabrics during the rinse cycle of home laundering operations. This is a widely used practice to impart to laundered fabrics a texture or hand that is smooth, pliable and fluffy to the touch (i.e., soft).

Liquid fabric softening compositions have long been known in the art and are widely utilized by consumers during the rinse cycles of automatic laundry operations. The term "fabric softening" as used herein and as known in the art refers to a process whereby a desirably soft hand and fluffy appearance are imparted to fabrics.

BACKGROUND ART

Compositions containing cationic nitrogenous compounds in the form of quaternary ammonium salts and substituted imidazolinium salts having two long chain acyclic aliphatic hydrocarbon groups are commonly used to provide fabric softening benefits when used in laundry rinse operations (See, for example, U.S. Pat. Nos. 3,644,203, Lamberti et al., issued Feb. 22, 1972; and U.S. Pat. No. 4,426,299, Verbruggen, issued Jan. 17, 1984; also "Cationic Surface Active Agents as Fabric Softeners," R. R. Egan, Journal of the American Oil Chemists' Society, January 1978, pages 118–121; and "How to Choose Cationics for Fabric Softeners," J. A. Ackerman, Journal of the American Oil Chemists' Society, June 1983, pages 1166–1169).

Quaternary ammonium salts having only one long chain acyclic aliphatic hydrocarbon group (such as monostearyltrimethyl ammonium chloride) are less commonly used because for the same chain length, compounds with two long alkyl chains were found to provide better softening performance than those having one long alkyl chain. (See, for example, "Cationic Fabric Softeners," W. P. Evans, Industry and Chemistry, July 1969, pages 893–903). U.S. Pat. No. 4,464,272, Parslow et al., issued Aug. 7, 1984, also teaches that monoalkyl quaternary ammonium compounds are less effective softeners.

Another class of nitrogenous materials that are sometimes used in fabric softening compositions are the non-quaternary amide-amines. A commonly cited material is the reaction product of higher fatty acids with hydroxy alkyl alkylene diamines. An example of these materials is the reaction product of higher fatty acids and hydroxyethylethylenediamine (See "Condensation Products from β-Hydroxyethylethylenediamine and Fatty Acids or Their Alkyl Esters and Their Application as Textile Softeners in Washing Agents," H. W. Eckert, Fette-Seifen-Anstrichmittel, September 1972, pages 527–533). These materials are usually cited generically along with other cationic quaternary ammonium salts and imidazolinium salts as softening actives in fabric softening compositions. (See U.S. Pat. Nos. 4,460,485, Rapisarda et al., issued July 17, 1984; U.S. Pat. No. 4,421,792, Rudy et al., issued Dec. 20, 1983; U.S. Pat. No. 4,327,133, Rudy et al., issued Apr. 27, 1982). U.S. Pat. No. 3,775,316, Berg et al., issued Nov. 27, 1973, discloses a softening finishing composition for washed laundry containing (a) the condensation product of hydroxyalkyl alkylpolyamine and fatty acids and (b) a quaternary ammonium compound mixture of (i) from 0% to 100% of quaternary ammonium salts having two long chain alkyl groups and (ii) from 100% to 0% of a germicidal quaternary ammonium compound of the formula $[R_5R_6R_7R_8N]^+A^-$ wherein $R_5$ is a long chain alkyl group, $R_6$ is a member selected from the group consisting of arylalkyl group and $C_3$-$C_{18}$ alkenyl and alkadienyl containing one or two C=C double bonds, $R_7$ and $R_8$ are $C_1$–$C_7$ alkyl groups, and A is an anion. U.S. Pat. No. 3,904,533, Neiditch et al., issued Sept. 9, 1975, teaches a fabric conditioning formulation containing a fabric softening compound and a low temperature stabilizing agent which is a quaternary ammonium salt containing one to three short chain $C_{10}$–Chd 14 alkyl groups; the fabric softening compound is selected from a group consisting of quaternary ammonium salts containing two or more long chain alkyl groups, the reaction product of fatty acids and hydroxyalkyl alkylene diamine, and other cationic materials.

It has been found that the common cationic fabric softeners can lose much of their effectiveness in the rinse bath by virtue of the carryover of detergent components from the wash cycle. The detrimental effect of anionic surfactants on cationic fabric softeners was discussed in U.S. Pat. No. 3,974,076, Wiersema et al., issued Aug. 10, 1976.

It has now been found that nonionic detergents also may have detrimental effect on the cationic fabric softeners, sometimes even more so than the anionic surfactants. The problem of interference by carryover detergents may be overcome by very thoroughly rinsing the fabrics. However, since the average user is not disposed to take such extreme measures, it is advantageous to have fabric softening compositions which perform well across major categories of detergents. Current representatives of major detergent categories are TIDE$^R$ (anionic detergents), WISK$^R$ (anionic detergents rich in LAS (linear alkylate sulfonate) surfactant) and CONCENTRATED ALL$^R$ (nonionic detergents).

OBJECTS OF THE INVENTION

It is an object of the present invention to provide compositions which have good softening performance across major categories of detergents. A further object of the invention is to develop a method to provide softness to laundry washed with those major categories of detergents.

Other objects of the present invention will become apparent in the light of the following disclosure.

SUMMARY OF THE INVENTION

The present invention relates to fabric softening compositions in liquid form for use in home laundry operations. The present invention is based on the discovery of the synergistic softening activity of the present composition relative to the softening activity of its components, and on its superior softening performance relative to conventional fabric softening agents such as ditallowdimethylammonium chloride when these compositions are added to the rinse cycle after the laundry is washed using representative detergents, namely, anionic TIDE powdered detergent, anionic WISK liquid detergent which is rich in LAS surfactant, and nonionic CONCENTRATED ALL powdered detergent.

According to the present invention, a fabric softening composition is provided in the form of an aqueous dispersion comprising from about 3% to about 35% by weight of a mixture consisting of:

(a) from about 10% to about 92% of the reaction product of higher fatty acids with a polyamine selected from the group consisting of hydroxyalkylalkylenediamines and dialkylenetriamines and mixtures thereof, and (b) from about 8% to about 90% of cationic nitrogenous salts having only one long chain acyclic aliphatic $C_{15-C22}$ hydrocarbon group, and optionally (c) from 0% to about 80% of cationic nitrogenous salts having two or more long chain acyclic aliphatic $C_{15-C22}$ hydrocarbon groups or one said group and an aryalkyl group.

In its method aspect, this invention provides a process of softening fabrics with the compositions defined above.

DETAILED DESCRIPTION OF THE INVENTION

We have now found that some binary compositions containing a mixture of: (a) reaction products of higher fatty acids with polyamines and (b) cationic nitrogenous salts having only one long chain acyclic aliphatic hydrocarbon group have synergistic softening performance relative to the softening performance of their components when these compositions are added to the rinse cycle after the laundry is washed using TIDE, WISK, or CONCENTRATED ALL detergents. These compositions also have better softening performance in said detergents relative to conventional fabric softening agents such as ditallowdimethylammonium chloride (DTDMAC) and to a ternary composition containing the above binary mixture and DTDMAC, when used at the same total level of softening actives. These findings are quite unexpected and have not been recognized or appreciated in the prior art.

The compositions of the present invention contain two essential components: (a) the reaction products of higher fatty acids with a polyamine selected from the group consisting of hydroxyalkylalkylenediamines and dialkylenetriamines and mixtures thereof, (b) cationic nitrogenous salts having only one long chain acyclic aliphatic $C_{15}$–$C_{22}$ hydrocarbon group, and optionally (c) cationic nitrogenous salts having two or more long chain acyclic aliphatic $C_{15}$–$C_{22}$ hydrocarbon groups. The three components (a), (b) and (c) are each expressed as plural Markush terms. Such terms as used herein are both singular, as well as plural, unless otherwise specified.

The amount of fabric softening agent in the compositions of this invention is from about 3% to about 35%, preferably from about 4% to about 27%, by weight of the composition. The lower limits are amounts needed to contribute effective fabric softening performance when added to laundry rinse baths in the manner which is customary in home laundry practice. The higher limits are suitable for concentrated products which provide the consumer with more economical usage due to a reduction of packaging and distributing costs.

THE COMPOSITION

The fabric softening composition comprises the following components:

I. from about 3% to about 35%, preferably from about 4% to about 27%, by weight of the total composition of a mixture comprising:

(a) from about 10% to about 92% of the reaction product of higher fatty acids with a polyamine selected from the group consisting of hydroxyalkylalkylenediamines and dialkylenetriamines and mixtures thereof;

(b) from about 8% to about 90% of cationic nitrogenous salts containing only one long chain acyclic aliphatic $C_{15}$–$C_{22}$ hydrocarbon group; and optionally, (c) from 0% to about 80% of cationic nitrogenous salts having two or more long chain acyclic aliphatic $C_{15}$–$C_{22}$ hydrocarbon groups or one said group and an arylalkyl group; said (a), (b) and (c) percentages being by weight of Component I; and II. the balance of the composition compising a liquid carrier selected from the group consisting of water and mixtures of the water and $C_1$–$C_4$ monohydric alcohols. As used herein, Component I comprises the mixture of fabric softening actives.

Following are the general descriptions of the essentials and optionals of the present compositions including certain specific examples. These examples are provided herein for purposes of illustration only and are not intended to limit the claims, unless otherwise specified.

Component I(a)

An essential softening agent (active) of the present invention is the reaction products of higher fatty acids with a polyamine selected from the group consisting of hydroxyalkylalkylenediamines and dialkylenetriamines and mixtures thereof. These reaction products are mixtures of several compounds in view of the multi-functional structure of the polyamines (see, for example, the publication by H. W. Eckert in Fette-Seifen-Anstrichmittel, cited above).

The preferred Component I(a) is a nitrogenous compound selected from the group consisting of the reaction product mixtures or some selected components of the mixtures. More specifically, the preferred Component I(a) is compounds selected from the group consisting of:

(i) the reaction product of higher fatty acids with hydroxyalkylalkylenediamines in a molecular ratio of about 2:1, said reaction product containing a composition having a compound of the formula:

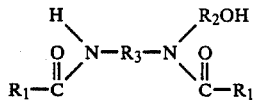

wherein $R_1$ is an acyclic aliphatic $C_{15}$–$C_{21}$ hydrocarbon group and $R_2$ and $R_3$ are divalent $C_1$–$C_3$ alkylene groups;

(ii) substituted imidazoline compounds having the formula:

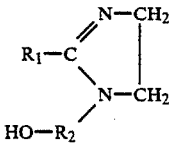

wherein $R_1$ and $R_2$ are defined as above;

(iii) substituted imidazoline compounds having the formula:

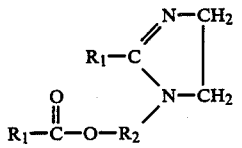

wherein $R_1$ and $R_2$ are defined as above;

(iv) the reaction product of higher fatty acids with dialkylenetriamines in a molecular ratio of about 2:1, said reaction product containing a composition having a compound of the formula:

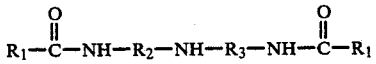

wherein $R_1$, $R_2$ and $R_3$ are defined as above; and (v) substituted imidazoline compounds having the formula:

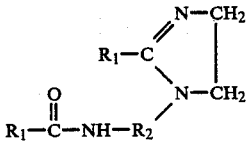

wherein $R_1$ and $R_2$ are defined as above; and mixtures thereof.

Component I(a)(i) is commercially available as Mazamide$^R$ 6, sold by Mazer Chemicals, or Ceranine$^R$ HC, sold by Sandoz Colors & Chemicals; here the higher fatty acids are hydrogenated tallow fatty acids and the hydroxyalkylalkylenediamine is N-2-hydroxyethylethylenediamine, and $R_1$ is an aliphatic $C_{15}$–$C_{17}$ hydrocarbon group, and $R_2$ and $R_3$ are divalent ethylene groups.

An example of Component I(a)(ii) is stearic hydroxyethyl imidazoline wherein $R_1$ is an aliphatic $C_{17}$ hydrocarbon group, $R_2$ is a divalent ethylene group; this chemical is sold under the trade names of Alkazine® ST by Alkaril Chemicals, Inc., or Schercozoline® S by Scher Chemicals, Inc.

An example of Component I(a)(iv) is N,N''-ditallowalkoyldiethylenetriamine where $R_1$ is an aliphatic $C_{15}$–$C_{17}$ hydrocarbon group and $R_2$ and $R_3$ are divalent ethylene groups.

An example of Component I(a)(v) is 1-tallowamidoethyl-2-tallowimidazoline wherein $R_1$ is an aliphatic $C_{15}$–$C_{17}$ hydrocarbon group and $R_2$ is a divalent ethylene group.

The Component I(a)(v) can also be first dispersed in a Bronstedt acid dispersing aid having a pKa value of not greater than 6; provided that the pH of the final composition is not greater than 8. Some preferred dispersing aids are formic acid, phosphoric acid, or methylsulfonic acid.

Both N,N''-ditallowalkoyldiethylenetriamine and 1-tallowethylamido-2-tallowimidazoline are reaction products of tallow fatty acids and diethylenetriamine, and are precursors of the cationic fabric softening agent methyl-1-tallowamidoethyl-2-tallowimidazolinium methylsulfate (see "Cationic Surface Active Agents as Fabric Softeners," R. R. Egan, Journal of the American Oil Chemicals'Society, January 1978, pages 118–121). N,N''-ditallowalkoyldiethylenetriamine and 1-tallowamidoethyl-2-tallowimidazoline can be obtained from Sherex Chemical Company as experimental chemicals. Methyl-1-tallowamidoethyl-2-tallowimidazolinium methylsulfate is sold by Sherex Chemical Company under the trade name Varisoft® 475.

Component I(b)

The preferred Component I(b) is a cationic nitrogenous salt containing one long chain acyclic aliphatic $C_{15}$–$C_{22}$ hydrocarbon group selected from the group consisting of:

(i) acyclic quaternary ammonium salts having the formula:

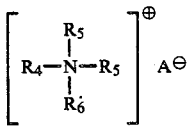

wherein $R_4$ is an acyclic aliphatic $C_{15}$–$C_{22}$ hydrocarbon group, $R_5$ and $R_6$ are $C_1$–$C_4$ saturated alkyl or hydroxyalkyl groups, and $A^\theta$ is an anion;

(iii) substituted imidazolinium salts having the formula:

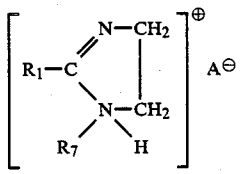

wherein $R_1$ is an acyclic aliphatic $C_{15}$–$C_{21}$ hydrocarbon group, $R_7$ is a hydrogen or a $C_1$–$C_4$ saturated alkyl or hydroxyalkyl group, and $A^{\ominus}$ is an anion;

(iii) substituted imidazolinium salts having the formula:

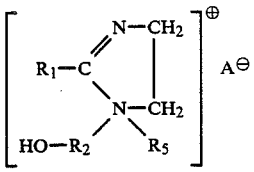

wherein $R_2$ is a divalent $C_1$–$C_3$ alkylene group and $R_1$, $R_5$ and $A^\theta$ are as defined above;

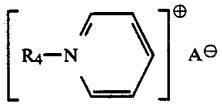

(iv) alkylpyridinium salts having the formula: wherein $R_4$ is an acyclic aliphatic $C_{16}$–$C_{22}$ hydrocarbon group and $A^\theta$ s an anion; and (v) alkanamide alkylene pyridinium salts having the formula:

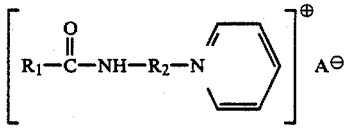

wherein $R_1$ is an acyclic aliphatic $C_{15}$–$C_{21}$ hydrocarbon group, $R_2$ is a divalent $C_1$–$C_3$ alkylene group, and $A^{\ominus}$ is an ion group; and mixtures thereof.

Examples of Component I(b)(i) are the monoalkyltrimethylammonium salts such as monotallowtrimethylammonium chloride, mono(hydrogenated tallow)-trimethylammonium chloride, palmityltrimethylammonium chloride and soyatrimethylammonium chloride, sold by Sherex Chemical Company under the trade names Adogen$^R$ 471, Adogen 441, Adogen 444, and Adogen 415, respectively. In these salts, $R_4$ is an acyclic aliphatic $C_{16}$–$C_{18}$ hydrocarbon group, and $R_5$ and $R_6$ are methyl groups. Mono(hydrogenated tallow)-trimethylammonium chloride and monotallowtrimethylammonium chloride are preferred. Other examples of Component I(b)(i) are behenyltrimethylammonium chloride wherein $R_4$ is a $C_{22}$ hydrocarbon group and sold under the trade name Kemamine$^R$ Q2803-C by Humko Chemical Division of Witco Chemical Corporation; soyadimethylethylammonium ethosulfate wherein $R_4$ is a $C_{16}$–$C_{18}$ hydrocarbon group, $R_5$ is a methyl group, $R_6$ is an ethyl group, and A is an ethylsulfate anion, sold under the trade name Jordaquat$^R$ 1033 by Jordan Chemical Company; and methyl-bis(2-hydroxyethyl)octadecylammonium chloride wherein $R_4$ is a $C_{18}$ hydrocarbon group, $R_5$ is a 2-hydroxyethyl group and $R_6$ is a methyl group and available under the trade name Ethoquad$^R$ 18/12 from Armak Company.

An example of Component I(b)(iii) is 1-ethyl-1-(2-hydroxyethyl)-2-isoheptadecylimidazolinium ethylsulfate wherein $R_1$ is a $C_{17}$ hydrocarbon group, $R_2$ is an ethylene group, $R_5$ is an ethyl group, and A is an ethylsulfate anion. It is available from Mona Industries, Inc., under the trade name Monaquat ® ISIES.

A preferred composition contains Component I(a) at a level of from about 50% to about 90% by weight of Component I and Component I(b) at a level of from about 10% to about 50% by weight of Component I.

Anion A

In the cationic nitrogenous salts herein, the anion $A^{\ominus}$ provides electrical neutrality. Most often, the anion used to provide electrical neutrality in these salts is a halide, such as fluoride, chloride, bromide, or iodide. However, other anions can be used, such as methylsulfate, ethylsulfate, hydroxide, acetate, formate, sulfate, carbonate, and the like. Chloride and methylsulfate are preferred herein as anion A.

Liquid Carrier

The liquid carrier is selected from the group consisting of water and mixtures of the water and short chain $C_1$–$C_4$ monohydric alcohols. Water used can be distilled, deionized, or tap water. Mixtures of water and up to about 15% of a short chain alcohol such as ethanol, propanol, isopropanol or butanol, and mixtures thereof, are also useful as the carrier liquid.

Optional Cationic Nitrogenous Salts I(c)

The preferred optional cationic nitrogenous salts having two or more long chain acyclic aliphatic $C_{15}$–$C_{22}$ hydrocarbon groups or one said group and an arylalkyl group are selected from the group consisting of:

(i) acyclic quaternary ammonium salts having the formula:

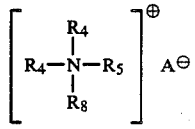

wherein $R_4$ is an acyclic aliphatic $C_{15}$–$C_{22}$ hydrocarbon group, $R_5$ is a $C_1$–$C_4$ saturated alkyl or hydroxyalkyl group, $R_8$ is selected from the group consisting of $R_4$ and $R_5$ groups, and $A^{\ominus}$ is an anion defined as above;

(ii) diamido quaternary ammonium salts having the formula:

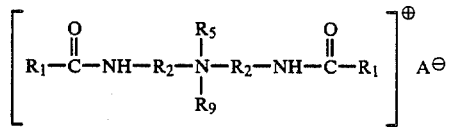

wherein $R_1$ is an acyclic aliphatic $C_{15}$–$C_{21}$ hydrocarbon group, $R_2$ is a divalent alkylene group having 1 to 3 carbon atoms, $R_5$ and $R_9$ are $C_1$–$C_4$ saturated alkyl or hydroxyalkyl groups, and $A^{\ominus}$ is an anion;

(iii) diamino alkoxylated quaternary ammonium salts having the formula:

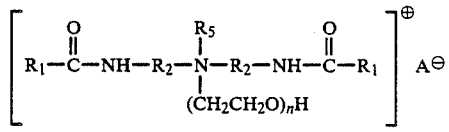

wherein n is equal to 1 to about 5, and $R_1$, $R_2$, $R_5$ and $A^{\ominus}$ are as defined above;

(iv) quaternary ammonium compounds having the formula:

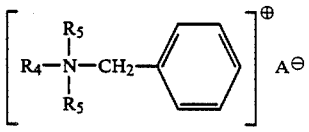

wherein $R_4$ is an acyclic aliphatic $C_{15}$–$C_{22}$ hydrocarbon group, $R_5$ is a $C_1$–$C_4$ saturated alkyl or hydroxyalkyl group, $A^{\ominus}$ is an anion;

(v) substituted imidazolinium salts having the formula:

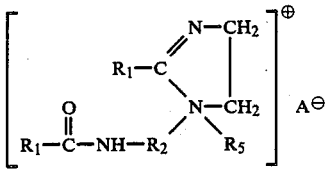

wherein $R_1$ is an acyclic aliphatic $C_{15}$–$C_{21}$ hydrocarbon group, $R_2$ is a divalent alkylene group having 1 to 3 carbon atoms, and $R_5$ and $A^{\ominus}$ are as defined above;

and (vi) substituted imidazolinium salts having the formula:

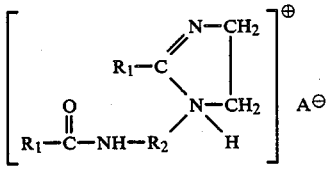

wherein $R_1$, $R_2$ and $A^{\ominus}$ are as defined above; and mixtures thereof.

Examples of Component I(c)(i) are the well-known dialkyldimethylammonium salts such as ditallowdimethylammonium chloride, ditallowdimethylammonium methylsulfate, di(hydrogenated tallow)dimethylammonium chloride, distearyldimethylammonium chloride, dibehenyldimethylammonium chloride. Di(hydrogenated tallow)dimethylammonium chloride and ditallowdimethylammonuim chloride are preferred. Examples of commercially available dialkyldimethylammonium salts usable in the present invention are di(hydrogenated tallow)dimethylammonium chloride (trade name Adogen 442), ditallowdimethylammonium chloride (trade name Adogen 470), distearyldimethylammonium chloride (trade name Arosurf® TA-100), all available from Sherex Chemical Company. Dibehenyldimethylammonium chloride wherein $R_4$ is an acyclic aliphatic $C_{22}$ hydrocarbon group is sold under the trade name Kemamine Q-2802C by Humko Chemical Division of Witco Chemical Corporation.

Examples of Component I(c)(ii) are methylbis(tallowamidoethyl)(2-hydroxyethyl)ammonium methylsulfate and methylbis(hydrogenated tallowamidoethyl)(2-hydroxyethyl)ammonium methylsulfate wherein $R_1$ is an acyclic aliphatic $C_{15}$–$C_{17}$ hydrocarbon group, $R_2$ is an ethylene group, $R_5$ is a methyl group, $R_9$ is a hydroxyalkyl group and A is a methylsulfate anion; these materials are available from Sherex Chemical Company under the trade names Varisoft 222 and Varisoft 110, respectively.

An example of Component I(c)(iv) is dimethylstearylbenzylammonium chloride wherein $R_4$ is an acyclic alphatic $C_{18}$ hydrocarbon group, $R_5$ is a methyl group and A is a chloride anion, Company and is sold under the trade names Varisoft SDC by Sherex Chemical and Ammonyx® 490 by Onyx Chemical Company.

Examples of Component I(c)(v) are 1-methyl-1-tallowamidoethyl-2-tallowimidazolinium methylsulfate and 1-methyl-1-(hydrogenated tallowamidoethyl)-2-(hydrogenated tallow)imidazolinium methylsulfate wherein $R_1$ is an acyclic aliphatic $C_{15}$–$C_{17}$ hydrocarbon group, $R_2$ is an ethylene group, $R_5$ is a methyl group and A is a chloride anion; they are sold under the trade names Varisoft 475 and Varisoft 445, respective, by Sherex Chemical Company.

A preferred composition contains Component I(c) at a level of from about 10% to about 80% by weight of said Component I. A more preferred composition also contains Component I(c) which is selected from the group consisting of: (i) di(hydrogenated tallow)dimethylammonium chloride and (v) methyl-1-tallowamidoethyl-2-tallowimidazolinium methylsulfate; and mixtures thereof. A preferred combination of ranges for Component I(a) is from about 10% to about 80% and for Component I(b) from about 8% to about 40% by weight of Component I.

Where Component I(c) is present, Component I is preferably present at from about 4% to about 27% by weight of the total composition. More specifically, this composition is more preferred wherein Component I(a) is the reaction product of about 2 moles of hydrogenated tallow fatty acids with about 1 mole of N-2-hydroxyethylethylenediamine and is present at a level of from about 10% to about 70% by weight of Component I; and wherein Component I(b) is mono(hydrogenated tallow)trimethylammonium chloride present at a level of from about 8% to about 20% by weight of Component I; and wherein Component I(c) is selected from the group consisting of di(hydrogenated tallow(dimethylammonium chloride, ditallowdimethylammonium chloride and methyl-1-tallowamidoethyl-2-tallowimidazolinium methylsulfate, and mixtures thereof; said Component I(c) is present at a level of from about 20% to about 75% by weight of Component I; and wherein the weight ratio of said di(hydrogenated tallow)dimethylammonium chloride to said methyl-1-tallowamidoethyl-2-tallowimidazolinium methylsulfate is from about 2:1 to about 6:1.

Other Optional Ingredients

Adjuvants can be added to the compositions herein for their known purposes. Such adjuvants include, but are not limited to, viscosity control agents, perfumes, emulsifiers, preservatives, antioxidants, bacteriocides, fungicides, colorants, dyes, fluorescent dyes, brighteners, opacifiers, freeze-thaw control agents, shrinkage control agents, and agents to provide ease of ironing. These adjuvants, if used, are added at their usual levels, generally each of up to about 5% by weight of the composition.

Viscosity control agents can be organic or inorganic in nature. Examples of organic viscosity modifiers are fatty acids and esters, fatty alcohols, and water-miscible solvents such as short chain alcohols. Examples of inorganic viscosity control agents are water-soluble ionizable salts. A wide variety of ionizable salts can be used. Examples of suitable salts are the halides of the group IA and IIA metals of the Periodic Table of the Elements, e.g., calcium chloride, magnesium chloride, sodium chloride, potassium bromide, and lithium chloride. Calcium chloride is preferred. The ionizable salts are particularly useful during the process of mixing the ingredients to make the compositions herein, and later to obtain the desired viscosity. The amount of ionizable salts used depends on the amount of active ingredients used in the compositions and can be adjusted according to the desires of the formulator. Typical levels of salts used to control the composition viscosity are from about 20 to about 6,000 parts per million (ppm), preferably from about 20 to about 4,000 ppm by weight of the composition.

Examples of bacteriocides used in the compositions of this invention are glutaraldehyde, formaldehyde, 2-bromo-2-nitropropane-1,3-diol sold by Inolex Chemicals under the trade name Bronopol ®, and a mixture of 5-chloro-2-methyl-4-isothiazolin-3-one and 2-methyl-4-isothiazoline-3-one sold by Rohm and Haas Company under the trade name Kathon$^R$ CG/ICP. Typical levels of bacteriocides used in the present compositions are from about 1 to about 1,000 ppm by weight of the composition.

Examples of antioxidants that can be added to the compositions of this invention are propyl gallate, available from Eastman Chemical Products, Inc., under the trade names Tenox ® PG and Tenox S-1, and butylated hydroxy toluene, available from UOP Process Division under the trade name Sustane ® BHT.

The present compositions may contain silicones to provide additional benefits such as ease of ironing and improved fabric feel. The preferred silicones are polydimethylsiloxanes of viscosity of from about 100 centistokes (cs) to about 100,000 cs, preferably from about 200 cs to about 60,000 cs. These silicones can be used as is, or can be conveniently added to the softener compositions in preemulsified form which is obtainable directly from the suppliers. Examples of these preemulsified silicones are 60% emulsion of polydimethylsiloxane (350 cs) sold by Dow Corning Corporation under the trade name DOW CORNING ® 1157 Fluid and 50% emulsion of polydimethylsiloxane (10,000 cs) sold by General Electric Company under the trade name General Electric ® SM 2140 Silicones. The optional silicone component can be used in an amount of from about 0.1% to about 6% by weight of the composition.

Other minor components include short chain alcohols such as ethanol and isopropanol which are present in the commercially available quaternary ammonium compounds used in the preparation of the present compositions. The short chain alcohols are normally present at from about 1% to about 10% by weight of the composition.

A preferred composition contains from about 0.2% to about 2% of perfume, from 0% to about 3% of polydimethylsiloxane, from 0% to about 0.4% of calcium chloride, from about 1 ppm to about 1,000 ppm of bacteriocide, from about 10 ppm to about 100 ppm of dye, and from 0% to about 10% of short chain alcohols, by weight of the total composition.

The pH of the compositions of this invention is generally adjusted to be in the range of from about 3 to about 8, preferably from about 4 to about 6. Adjustment of pH is normally carried out by including a small quantity of free acid in the formulation. Because no strong pH buffers are present, only small amounts of acid are required. Any acidic material can be used; its selection can be made by anyone skilled in the softener arts on the basis of cost, availability, safety, etc. Among the acids that can be used are hydrochloric, sulfuric, phosphoric, citric, maleic, and succinic. For the purposes of this invention, pH is measured by a glass electrode in full strength softening composition in comparison with a standard calomel reference electrode.

The liquid fabric softening compositions of the present invention can be prepared by convenional methods. A convenient and satisfactory method is to prepare the softening active premix at about 72–77° C., which is then added with stirring to the hot water seat. Temperature-sensitive optional components can be added after the fabric softening composition is cooled to a lower temperature.

The liquid fabric softening compositions of this invention are used by adding to the rinse cycle of conventional home laundry operations. Generally, rinse water has a temperature of from about 5° C. to about 60° C.. The concentration of the fabric softener actives of this invention is generally from about 10 ppm to about 200 ppm, preferably from about 25 ppm to about 100 ppm, by weight of the aqueous rinsing bath.

In general, the present invention in its fabric softening method aspect comprises the steps of (1) washing fabrics in a conventional washing machine with a detergent composition; and (2) rinsing the fabrics in a bath which contains the abovedescribed amounts of the fabric softeners; and (3) drying the fabrics. When multiple rinses are used, the fabric softening composition is preferably added to the final rinse. Fabric drying can take place either in an automatic dryer or in the open air.

EXAMPLES

The following Compositions I and V and their fabric softening performance evaluation as compared to their individual components as illustrated by Compositions II, III and IV, used at equivalent levels of actives, illustrate the benefits achieved by the utilization of the compositions and methods of this invention. These examples are illustrative of the invention herein and are not to be construed as limiting thereof.

Composition I

Composition I is a composition of this invention and contains as fabric softening active a 39.2:60.8 mixture of mono(hydrogenated tallow)trimethylammonium chloride and the reaction product of 2 moles of fatty acids with 1 mole of N-2-hydroxyethylethylenediamine. It was prepared as follows:

4.41 parts of reaction product of hydrogenated tallow fatty acids with N-2-hydroxyethylethylenediamine [Mazamide 6] were weighed into a premix vessel, followed by 5.68 parts of commercial mono(hydrogenated tallow)trimethylammonium chloride [Adogen 441, 50% active in 50% isopropanol]. This premix was melted, mixed and heated to 77° C. The premix was then added, with agitation, to a mix vessel containing 89.87 parts of distilled water heated to 66° C., followed by 0.02 part of a commercial mixture of 5-chloro-2-methyl-4-isothiazolin-3-one and 2-methyl-4-isothiazolin-3-one [Kathon CG/ICP, 1.5% active, room temperature]. The mixture was cooled to 49° C. with continued agitation and 0.02 part of a $CaCl_2$ solution [25% aqueous solution, room temperature was added. At this stage the pH of the mixture was about 9.4. This pH was adjusted to 6.0 by the addition of a small amount of concentrated sulfuric acid.

Composition II

Composition II contained the reaction product of 2 moles fatty acids with one mole of N-2-hydroxyethylethylenediamine as the sole fabric softening active ingredient and was prepared using the preparation procedure of Composition I above, with the exception that 7.25 parts of Mazamide 6 was used and no Adogen 441 was used. The amount of distilled water used was 92.71 parts.

Composition III

Composition III contained mono(hydrogenated tallow)trimethylammonium chloride as the sole fabric softening active ingredient and was prepared using the preparation procedure of Composition I with the exception that 14.5 parts of Adogen 441 was used and no Mazamide 6 was used. The amount of distilled water used was 85.46 parts.

Composition IV

Composition IV contained di(hydrogenated tallow)-dimethylammonium chloride as the sole fabric softening active ingredient and was prepared using the preparation procedure of Composition I with the exception that 8.735 parts of di(hydrogenated tallow)-dimethylammonium chloride [Adogen 448E, 83% active, containing about 5.8% by weight of mono(hydrogenated tallow)trimethylammonium chloride and 13% ethanol] was used instead of the mixture of Mazamide 6 and Adogen 441. The amount of water used was 91.225 parts. The unadjusted pH of the emulsion was about 4.5 and was adjusted to pH 6.1 by the addition of a small amount of a 20% aqueous solution of sodium hydroxide.

Composition V

Composition V contained as fabric softening active a mixture of the reaction product of 2 moles fatty acids with 1 mole N-2-hydroxyethylethylene diamine, mono(hydrogenated tallow)trimethylammonium chloride and di(hydrogenated tallow)dimethylammonium chloride. It was prepared using the preparation procedure of Composition I using 1.25 parts of Mazamide 6, 1 part of Adogen 441, 6.625 parts of Adogen 448E and 91.085 parts of distilled water.

Compositions I through V all have 7.25% of fabric softening active by weight of the total composition. These compositions are summarized below in Tables 1A and 1B.

TABLE 1A

| Composition No. Ingredients | I Wt. % | II Wt. % | III Wt. % |
|---|---|---|---|
| Mazamide 6 | 4.41 (60.8)[c] | 7.25 | — |
| MTTMAC[a] | 2.84 (39.2)[c] | — | 7.25 |
| DTDMAC[b] | — | — | — |
| $CaCl_2$ | 50 ppm | 50 ppm | 50 ppm |
| Kathon CG | 3 ppm | 3 ppm | 3 ppm |
| Isopropanol | 2.84 | — | 7.25 |
| Distilled Water | Balance | Balance | Balance |
| Total Active (Wt. %) | 7.25 | 7.25 | 7.25 |
| pH | 6.0 | 6.1 | 6.0 |

[a]Mono(hydrogenated tallow)trimethylammonium chloride
[b]Di(hydrogenated tallow)dimethylammonium chloride.
[c]Numbers in parentheses are precentages by weight of Component I.

TABLE 1B

| Composition No. Ingredients | IV Wt. % | V Wt. % |
|---|---|---|
| Mazamide 6 | — | 1.25 (17.2)[c] |
| MTTMAC | 0.51 (7.0)[c] | 0.88 (12.1)[c] |
| DTDMAC | 6.74 (93.0)[c] | 5.12 (70.6)[c] |
| $CaCl_2$ | 50 ppm | 50 ppm |
| Kathon CG | 3 ppm | 3 ppm |
| Isopropanol | — | 0.50 |
| Ethanol | 1.14 | 0.86 |
| Distilled Water | Balance | Balance |
| Total Active (Wt. %) | 7.25 | 7.25 |

TABLE 1B-continued

| Composition No. Ingredients | IV Wt. % | V Wt. % |
|---|---|---|
| pH | 6.1 | 6.0 |

[c]Numbers in parentheses are percentages by weight of Component I.

The above five compositions were tested for their fabric softening performance by the following subjective evaluation method. Representative laundry loads which each include 1 poly/cotton shirt, 1 polyester blouse, 1 pair of polyester trousers, 1 pair of poly/cotton denims, 1 poly/cotton tee shirt, 2 cotton tee shirts, 1 nylon slip, 1 pair of nylon socks, 3 cotton bath towels, 2 poly/cotton pillow cases, and 8 cotton terry towelling test cloths were washed in a Kenmore® heavy duty Automatic Washer Model 110 with a selected detergent at its recommended usage. The amount of water used is about 75.7 liters, water hardness is about 7 grains/gallon, wash water temperature is about 38° C. and rinse water temperature is about 18–21° C.. In the rinse cycle, 68 ml. of a selected fabric softening composition was added resulting in about 65 ppm of active softening agent in the aqueous rinse bath. The treated laundry load was then dried in a Kenmore Heavy Duty Electric Dryer Model 110 for 45 minutes at high heat setting.

The following procedure was followed for the treatment of the test tery cloths: after the wash water was removed (spun out) and before the rinse water and the fabric softening composition were added, the 8 test terry cloths were collected, then 4 of them were tucked (unexposed) inside the laundry bundle and the remaining 4 were placed on top (exposed) of the laundry bundle. After drying, the "exposed" test terry cloths of one treatment were compared with the "exposed" terry cloths of the other treatment for softness, and likewise for the "unexposed" terry cloths. The overall relative rating was the average of these two comparison results for the "exposed" and "unexposed" terry cloths.

The relative softening performance of any two fabric softening compositions was evaulated by means of a panel of expert graders who compared the softness of the terry towelling test cloths treated by these two compositions. Comparison between different cloths was expressed in terms of panel score units (PSU) where 0 PSU=No difference
1 PSU=Small difference
2 PSU=Moderate difference
3 PSU=Large difference
4 PSU=Very large difference This is a relative scale and each PSU value is applicable only for the pair of treatments considered, but is not additive to be used for comparison of different pair tests.

In order to illustrate the benefits achieved by the utilization of the compositions and methods of this invention, the softening performance of the binary Composition I and the ternary Composition V were compared with that of the single-component Compositions (II–IV). Table 2 shows the results of the fabric softening composition treatments after the laundry loads were washed in TIDE, a granular heavy duty laundry detergent in which the surfactant is primarily of the anionic type; WISK, a liquid heavy duty laundry detergent in which the surfactant is primarily of the anionic type; and CONCENTRATED ALL, a granular heavy duty laundry detergent in which the surfactant is of a nonionic type. In this table, a positive PSU value indicates that the test cloths treated with the composition on the left-hand side were softer than the test cloths treated by the composition on the right-hand side by the number of PSU's given.

As can be seen in Table 2, the binary Composition I of the present invention shows a synergistic softening activity across the detergent types when compared with the two individual materials making up the compositions (namely, Compositions II and III), as well as having better softening performance when compared with the DTDMAC Composition IV and the ternary composition containing Mazamide 6, MTTMAC and DTDMAC (Composition V). It also can be seen that the ternary composition (Composition V) also has superior performance relative to its components (Compositions II–IV) across the detergent types, and is also a preferred composition of the present invention.

TABLE 2

| | Relative Softening Performance (PSU) | | |
|---|---|---|---|
| Pair Test | Tide Wash | Wisk Wash | Concentrated All Wash |
| I vs. II | 2.8 | 2.5 | 2.3 |
| I vs. III | 2.6 | 2.4 | 3.0 |
| I vs. IV | 0.2 | 0.4 | 1.4 |
| I vs. V | 0.5 | 0.1 | 0.9 |
| V vs. II | 3.0 | 2.4 | 2.1 |
| V vs. III | 2.5 | 2.4 | 2.5 |
| V vs. IV | 0.2 | 0.4 | 1.4 |

The following Compositions VI to VIII in Table 3A and Compositions IX to XI in Table 3B are within the scope of this invention and are prepared by the same general procedure set forth for Composition I, hereinabove. These examples are provided herein for purposes of illustration only and are not intended to limit the claims.

TABLE 3A

| Composition No. Ingredients | VI Wt. % | VII Wt. % | VIII Wt. % |
|---|---|---|---|
| Fatty Acid/Polyamine Reaction Product | 3.60[a] (72.0)[b] | 5.00[c] (71.4) | 2.00[a] (25.5) |
| MTTMAC[d] | 1.40 (28.0) | 2.00 (28.6) | 0.80 (10.2) |
| DTDMAC[e] | — | — | 4.03 (51.5) |
| Imidazolinium Salt[f] | — | — | 1.00 (12.8) |
| Preemulsified Polydimethylsiloxane[g] | — | — | 1.50 |
| Perfume[h] | 0.50 | 0.50 | 0.42 |
| $CaCl_2$ Viscosity Modifier | — | — | 50 ppm |
| Polar Brilliant Blue Dye[i] | 22.5 ppm | 22.5 ppm | 22.5 ppm |
| Kathon CG/ICP Bacteriocide | 3 ppm | 3 ppm | 3 ppm |
| Isopropanol | 2.00 | 2.00 | 0.60 |
| Ethanol | — | — | 0.68 |
| Distilled Water | Balance | Balance | Balance |

[a]Reaction product of 2 moles of hydrogenated tallow fatty acid with 1 mole of N—2-hydroxyethylethylenediamine (Mazamide 6)
[b]Numbers in parentheses are percentages by weight of Component I.
[c]1-Tallowamidoethyl-2-tallowimidazoline
[d]Mono(hydrogenated tallow)trimethylammonium chloride
[e]Di(hydrogenated tallow)dimethylammonium chloride
[f]Methyl-1-tallowamidoethyl-2-tallowimidazolinium methylsulfate
[g]General Electric SM 2140 Silicones (50% active), added to the water seat
[h]added to the water seat, after cooling to about 50° C.
[i]added to the premix.

TABLE 3B

| Composition No. Ingredients | IX Wt. % | X Wt. % | XI Wt. % |
|---|---|---|---|
| Fatty Acid/Polyamine Reaction Product | 15.00[a] (75.0)[b] | 12.00[a] (70.6) | 3.00[a] (14.6) |
| MTTMAC[c] | 5.00 (25.0) | 3.14 (18.5) | 2.41 (11.8) |
| DTDMAC[d] | — | 1.86 (10.9) | 12.09 (59.0) |
| Imidazolinium Salt[e] | — | — | 3.00 (14.6) |
| Preemulsified Polydimethylsiloxane[f] | — | — | 1.50 |
| Perfume[g] | 0.75 | 0.75 | 1.30 |
| $CaCl_2$ Viscosity Modifier | — | — | 0.12 |
| Polar Brilliant Blue Dye[h] | 45 ppm | 45 ppm | 45 ppm |
| Kathon CG/ICP Bacteriocide | 3 ppm | 3 ppm | 4 ppm |
| Isopropanol | 5.00 | 3.00 | — |
| Ethanol | — | 0.31 | 2.04 |
| Distilled Water | Balance | Balance | Balance |

[a]Reaction product of 2 moles tallow fatty acid with 1 mole of N—2-hydroxyethylethylenediamine (Mazamide 6)
[b]Numbers in parentheses are percentages by weight of Component I.
[c]Mono(hydrogenated tallow)trimethylammonium chloride
[d]Di(hydrogenated tallow)dimethylammonium chloride
[e]Methyl-1-tallowamidoethyl-2-tallowimidazolinium methylsulfate
[f]Dow Corning 1157 Fluid (60% active), added to the water seat
[g]added to the water seat, after cooling to about 50° C.
[h]added to the premix.

Compositions VI to VIII have fabric softening active levels in the conventional ranges while Compositions IX to XI are concentrated compositions having high levels of softening actives. Compositions VI to XI have good fabric softening performance across detergent types.

TABLE 4

| Ingredients | Composition No. XII* Wt. % |
|---|---|
| Mazamide 6 | 2.00 |
| MTTMAC | 0.80 |
| DTDMAC | 4.03 |
| Imidazolinium salt | 1.00 |
| Preemulsified Polydimethylsiloxane | 0.40 |
| Perfume | 0.45 |
| $H_2SO_4$ | 270 ppm |
| Blue Dye | 34 ppm |
| Antioxidant | 25 ppm |
| $CaCl_2$ | 5 ppm |
| Kathon CG/ICP | 3 ppm |
| Isopropanol | 0.11 |
| Ethanol | 0.68 |
| Deionized Water | Balance |

*Same notations as in Table 3B.

Composition XII was made by the following high shear milling process: 200 parts of Mazamide 6, 26 parts of predried Adogen 441 (97% active), 522 parts of Adogen 448E, 111 parts of methyl1-tallowamidoethyl-2-tallowimidazolinium methylsulfate [Varisoft 475, 90% active and 10% isopropanol], and 25 parts of blue dye solution (1.35% active) were weighed into a premix vessel. This premix was melted, mixed and heated to 77° C. Two parts of Kathon CG/ICP were then added to the premix. The melted premix and 45 parts of perfume were then added with mixing to a mix vessel containing 26 parts of predried Adogen 441 in 8972 parts of deionized water. This mixture was high shear mixed via milling. An amount of 67 parts of preemulsified polydimethylsiloxane [Dow Corning DC 1157 Fluid, 60% active] and 2.5 parts of antioxidant (10% active) were added with mixing, and the mixture was cooled to 50° C. Two parts of concentrated sulfuric acid (98% active) were added to adjust the product pH to 5.0 and 0.2 part of a $CaCl_2$ solution (25% aqueous solution) was added to control product viscosity. The product was then cooled to room temperature.

What is claimed is:

1. An aqueous fabric softening composition comprising the following components:

I. from about 3% to about 35% by weight of the composition of a mixture comprising:

(a) from about 10% to about 92% of the reaction product of higher fatty acids with a polyamine selected from the group consisting of hydroxyalkyl alkylene diamines and dialkylene triamines and mixtures thereof;

(b) from about 8% to about 90% of cationic nitrogenous salts having only one long chain acyclic aliphatic $C_{15}$–$C_{22}$ hydrocarbon group; and (c) from 0% to about 80% of cationic nitrogenous salts having two or more long chain acyclic aliphatic $C_{15}$–$C_{22}$ hydrocarbon groups or one said group and one arylalkyl group;

all by weight of Component I; and

II. the balance of the composition comprising from about 65% to about 97% of an aqueous carrier selected from the group consisting of water and mixtures of water and up to about 15% of $C_1$–$C_4$ monohydric alcohols; and wherein when said (b) is an acyclic quaternary ammonium salt with said one long chain and three $C_1$–$C_4$ chains; and wherein said $C_1$–$C_4$ chains are saturated alkyl groups.

2. The composition of claim 1 wherein said Component I(a) is a nitrogenous compound selected from the group consisting of:

(i) the reaction product of higher fatty acids with hydroxyalkylalkylenediamines in a molecular ratio of about 2:1, said reaction product containing a composition having a compound of the formula:

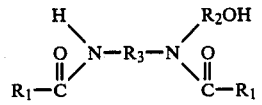

wherein $R_1$ is an acyclic aliphatic $C_{15}$–$C_{21}$ hydrocarbon group and $R_2$ and $R_3$ are divalent $C_1$–$C_3$ alkylene groups;

(ii) substituted imidazoline compounds having the formula:

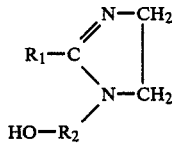

wherein $R_1$ and $R_2$ are defined as above;

(iii) substituted imidazoline compounds having the formula:

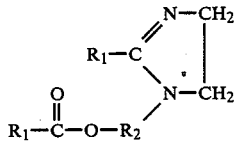

wherein $R_1$ and $R_2$ are defined as above;

(iv) the reaction product of higher fatty acids with dialkylenetriamines in a molecular ratio of about 2:1, said reaction product containing a composition having a compound of the formula:

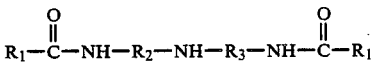

wherein $R_1$, $R_2$ and $R_3$ are defined as above; and (v) substituted imidazoline compounds having the formula:

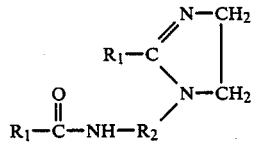

wherein $R_1$ and $R_2$ are defined as above; and mixtures thereof.

3. The composition of claim 1 wherein said Component I(b) is a cationic nitrogenous salt containing one long chain acyclic aliphatic $C_{15}$–$C_{22}$ hydrocarbon group, selected from the group consisting of:

(i) acyclic quaternary ammonium salts having the formula:

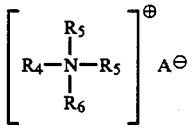

wherein $R_4$ is an acyclic alphatic $C_{15}$–$C_{22}$ hydrocarbon group, $R_5$ and $R_6$ are $C_1$–$C_4$ saturated alkyl or hydroxyalkyl groups, and $A^{\ominus}$ is an anion;

(ii) substituted imidazolinium salts having the formula:

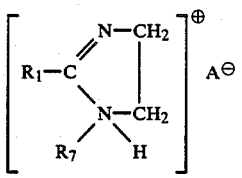

wherein $R_1$ is an acyclic aliphatic $C_{15}$–$C_{21}$ hydrocarbon group, $R_7$ is a hydrogen or a $C_1$–$C_4$ saturated alkyl or hydroxyalkyl group, and $A^{\ominus}$ is an anion;

(iii) substituted imidazolinium salts having the formula:

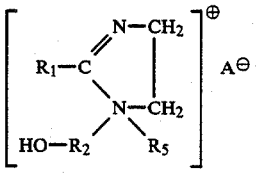

wherein $R_2$ is a divalent $C_1$–$C_3$ alkylene group and $R_1$, $R_5$ and $A^{\ominus}$ are as defined above;

(iv) alkylpyridinium salts having the formula:

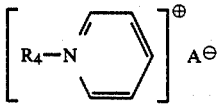

wherein $R_4$ is an acyclic aliphatic $C_{16}$–$C_{22}$ hydrocarbon group and $A^{\ominus}$ is an anion; and (v) alkanamide alkylene pyridinium salts having the formula:

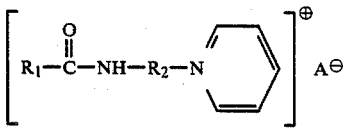

wherein $R_1$ is an acyclic aliphatic $C_{15}$–$C_{21}$ hydrocarbon group and $R_2$ is a divalent $C_1$–$C_3$ alkylene group, and $A^{\ominus}$ is an anion; and mixtures thereof.

4. The composition of claim 1, 2 or 3 wherein said Component I(a) is present at a level of from about 50% to about 90% by weight of Component I and said Component I(b) is present at a level of from about 10% to about 50% by weight of Component I.

5. The composition of claim 4 wherein said Component I(a) is the reaction product of about two moles of hydrogenated tallow fatty acids with about one mole of N-2-hydroxyethylethylenediamine.

6. The composition of claim 4 wherein said Component I(a) is the substituted imidazoline compound having the formula:

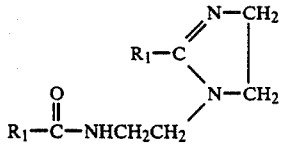

wherein $R_1$ is an acyclic aliphatic $C_{15}$–$C_{17}$ hydrocarbon group.

7. The composition of claim 2 wherein said composition comprises said Component I(a)(v) and wherein said Component I(a)(v) is dispersed in a dispersing aid selected from the group of Bronstedt acids having a pKa value of not greater than 6; provided that the pH of the final composition is not greater than 8.

8. The composition of claim 7 wherein the dispersing aid is formic acid, phosphoric acid, or methylsulfonic acid.

9. The composition of claim 4 wherein said Component I(b) is the acyclic quaternary ammonium salt having the formula:

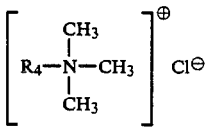

wherein $R_4$ is an acyclic aliphatic $C_{16}$–$C_{22}$ hydrocarbon group.

10. The composition of claim 4 wherein said composition has from about 0.2% to about 2% by perfume, from about 0% to about 3% of polydimethylsiloxane, from about 1 ppm to about 1,000 ppm of bacteriocide, from about 20 ppm to about 100 ppm of an antioxidant, from about 10 ppm to about 100 ppm of dye, and from 0% to about 10% of short chain alcohols, by weight of the composition.

11. The composition of claim 1, 2 or 3 wherein said Component I(c) is present at from about 10% to about 80% by weight of said Component I.

12. The composition of claim 11 wherein said Component I(c) is selected from the group consisting of:

(i) acyclic quaternary ammonium salts having the formula:

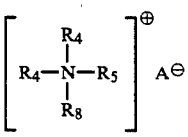

wherein $R_4$ is an acyclic aliphatic $C_{15}$–$C_{22}$ hydrocarbon group, $R_5$ is a $C_1$–$C_4$ saturated alkyl or hydroxyalkyl group, $R_8$ is selected from the group consisting of $R_4$ and $R_5$ groups, and $A^{\ominus}$ is an anion;

(ii) diamido quaternary ammonium salts having the formula:

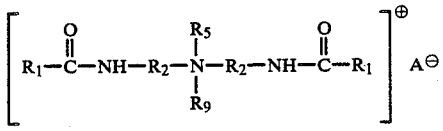

wherein $R_1$ is an acyclic aliphatic $C_{15}$–$C_{21}$ hydrocarbon group, $R_2$ is a divalent alkylene group having 1 to 3 carbon atoms, $R_5$ and $R_9$ are $C_1$–$C_4$ saturated alkyl or hydroxyalkyl groups, and $A^{\ominus}$ is an anion;

(iii) diamino alkoxylated quaternary ammonium salts having the formula:

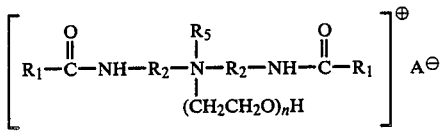

wherein n is equal to 1 to about 5, and $R_1$, $R_2$, $R_5$ and $A^{\ominus}$ are as defined above;

(iv) quaternary ammonium compounds having the formula:

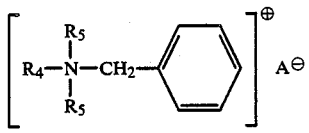

wherein $R_4$ is an acyclic aliphatic $C_{15}$–$C_{22}$ hydrocarbon group, $R_5$ is a $C_1$–$C_4$ saturated alkyl or hydroxyalkyl group, $A^{\ominus}$ is an anion;

(v) substituted imidazolinium salts having the formula:

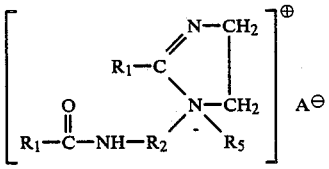

wherein $R_1$ is an acyclic aliphatic $C_{15}$–$C_{21}$ hydrocarbon group, $R_2$ is a divalent alkylene group having 1 to 3 carbon atoms, and $R_5$ and $A^{\ominus}$ are as defined above; and (vi) substituted imidazolinium salts having the formula:

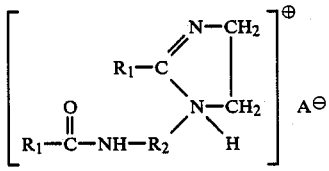

wherein $R_1$, $R_2$ and $A^{\ominus}$ are as defined above; and mixtures thereof.

13. The composition of claim 11 wherein said Component I(c) is selected from the group consisting of: di(hydrogenated tallow)dimethylammonium chloride, ditallowdimethylammonium chloride, and methyl-1-tallowamidoethyl-2-tallowimidazolinium methylsulfate; and mixtures thereof.

14. The composition of claim 11 wherein said Component I(a) is present at from about 10% to about 80% and said Component I(b) is present at from about 8% to about 40% by weight of Component I.

15. The composition of claim 14 wherein said Component I is present at from about 4% to about 27% by weight of the total composition.

16. The composition of claim 15 wherein said Component I(a) is the reaction product of about 2 moles of hydrogenated tallow fatty acids with about 1 mole of N-2-hydroxyethylethylenediamine and present at from about 10% to about 70%; said Component I(b) is mono(hydrogenated tallow) trimethylammonium chloride present at from about 8% to about 20%; and said Component I(c) is di(hydrogenated tallow)dimethylammonium chloride and present at from about 20% to about 75% by weight of Component I.

17. The composition of claim 15 wherein said Component I(c) is a mixture of di(hydrogenated tallow)-dimethylammonium chloride and methyl-1-tallowamidoethyl-2-tallowimidazolinium methylsulfate present at from about 20% to about 75% by weight of Component I.

18. The composition of claim 17 wherein the weight ratio of said di(hydrogenated tallow)dimethylammonium chloride to said methyl1-tallowamidoethyl-2-tallowimidazolinium methylsulfate is from about 2:1 to about 6:1.

19. The composition of claim 14 further comprising from about 0.2% to about 2% of perfume, from 0% to about 3% of polydimethylsiloxane, from 0% to about 0.4% of calcium chloride, from about 20 ppm to about 100 ppm of an antioxidant, from about 1 ppm to about 1,000 ppm of bacteriocide, from about 10 ppm to about 100 ppm of dye, and from 0% to about 10% of short chain alcohols, by weight of the total composition.

20. A method for softening fabrics comprising (1) washing said fabrics with a detergent composition and (2) rinsing the fabrics in a bath which contains an effective amount of an aqueous fabric softening composition comprising the following components:

I. from about 3% to about 35% by weight of the composition of a mixture comprising:

(a) from about 10% to about 92% of the reaction product of higher fatty acids with a polyamine selected from the group consisting of hydroxyalkyl alkylene diamines and dialkylene triamines and mixtures thereof;

(b) from about 8% to about 90% of cationic nitrogenous salts having only one long chain acyclic aliphatic $C_{15}$–$C_{22}$ hydrocarbon group; and (c) from 0% to about 80% of cationic nitrogenous salts having two or more long chain acyclic aliphatic $C_{15}$–$C_{22}$ hydrocarbon groups or one said group and one arylalkyl group; all by weight of Component I; and II. the balance of the composition comprising from about 65% to about 97% of an aqueous carrier selected from the group consisting of water and mixtures of water and up to about 15% of $C_1$–$C_4$ monohydric alcohols; and wherein said rinse bath contains from about 10 ppm to about 200 ppm of said fabric softening mixture; and wherein said (b) is an acyclic quaternary ammonium salt with said one long chain and three $C_1$–$C_4$ chains; and wherein said $C_1$–$C_4$ chains are saturated alkyl groups.

21. The method of claim 20 wherein said rinse bath contains from about 25 ppm to about 100 ppm of said fabric softening mixture.

22. The composition of claim 1 wherein said composition is prepard with high shear mixing.

23. The composition of claim 20 wherein said composition is prepared with high shear mixing.

* * * * *

UNITED STATES PATENT AND TRADEMARK OFFICE

CERTIFICATE OF CORRECTION

PATENT NO. : 4,855,072

DATED : August 8, 1989

INVENTOR(S) : Toan Trinh, Errol H. Wahl, Donald M. Swartley and Ronald L. Hemingway It is certified that error appears in the above-identified patent and that said Letters Patent is hereby corrected as shown below:

Col. 2, line 14, "Chd 14" should read -- $C_{14}$ --.

Col. 3, line 37 "or" should read --nor --.

Col. 4, line 13, "said" should start new line and be indented.

Col. 6, line 27, "(iii)" should read -- (ii) --.

Col. 6, line 41, "Al/4" should read -- $A^{\theta}$ --.

Col. 6, line 64, "(iv) alkylpyridinium salts having the formula:" should be printed above the formula.

Col. 6, line 66, "s" should read -- is --.

Col. 7, line 11, "Al/4" should read -- $A^{\theta}$ --.

Col. 7, line 11, "and" should start new line and be indented.

Col. 7, line 51, "Al/4" should read -- $A^{\theta}$ --.

Col. 8, line 38, "Al/4" should read -- $A^{\theta}$ --.

Col. 8, line 53, "Al/4" should read -- $A^{\theta}$ --.

Col. 8, line 66, "Al/4" should read -- $A^{\theta}$ --.

Col. 9, line 12, "Al/4" should read -- $A^{\theta}$ --.

Col. 9, line 26, "Al/4" should read -- $A^{\theta}$ --.

Col. 9, line 60, delete "Company".

Col. 9, line 62, after "cal" insert -- Company --.

UNITED STATES PATENT AND TRADEMARK OFFICE

CERTIFICATE OF CORRECTION

PATENT NO. : 4,855,072

DATED : August 8, 1989

INVENTOR(S) : Toan Trinh, Errol H. Wahl, Donald M. Swartley and Ronald L. Hemingway It is certified that error appears in the above-identified patent and that said Letters Patent is hereby corrected as shown below:

Col. 10, line 2, "respective" should read -- respectively --.

Col. 17, line 28, "methyll" should read -- methyl-1 --.

Col. 18, line 1, "and" should start a new line and be indented.

Col. 18, line 63, "and" should start a new line and be indented.

Col. 19, line 12, "A1/4" should read -- $A^{\theta}$ --.

Col. 19, line 26, "A1/4" should read -- $A^{\theta}$ --.

Col. 19, line 39, "A1/4" should read -- $A^{\theta}$ --.

Col. 19, line 49, "A1/4" should read -- $A^{\theta}$ --.

Col. 19, line 61, "A1/4" should read -- $A^{\theta}$ --.

Col. 20, line 66, "A1/4" should read -- $A^{\theta}$ --.

Col. 21, line 11, "A1/4" should read -- $A^{\theta}$ --.

Col. 21, line 22, "A1/4" should read -- $A^{\theta}$ --.

Col. 21, line 34, "A1/4" should read -- $A^{\theta}$ --.

Col. 21, line 48, "A1/4" should read -- $A^{\theta}$ --.

Col. 21, line 59, "A1/4" should read -- $A^{\theta}$ --.

Col. 22, line 23, "methyll" should read -- methyl-1 --.

Col. 19, line 61 "and" should start a new line and be indented.

Col. 21, line 59 "and" should start a new line and be indented.

UNITED STATES PATENT AND TRADEMARK OFFICE

CERTIFICATE OF CORRECTION

PATENT NO. : 4,855,072

DATED : August 8, 1989

INVENTOR(S) : Toan Trinh, Errol H. Wahl, Donald M. Swartley and Ronald L. Hemingway It is certified that error appears in the above-identified patent and that said Letters Patent is hereby corrected as shown below:

Col. 22, line 50, "all" should start new line and be indented.

Col. 22, line 56, "and" should start new line and be indented.

Col. 22, line 58, after "wherein" insert -- when --.

Col. 22, line 65, "prepard" should read -- prepared.

Signed and Sealed this

Twenty-first Day of May, 1991

*Attest:*

HARRY F. MANBECK, JR.

*Attesting Officer*

*Commissioner of Patents and Trademarks*